US006902460B2

(12) United States Patent
Ogino

(10) Patent No.: US 6,902,460 B2
(45) Date of Patent: Jun. 7, 2005

(54) HAND-THROWN TOY PARACHUTE AND METHOD OF MANUFACTURING THE SAME

(76) Inventor: Kouhei Ogino, 2-7-6, Higashi, Kurihashi-cho, Kitakatsushika-gun, Saitama 349-1103 (JP)

( * ) Notice: Subject to any disclaimer, the term of this patent is extended or adjusted under 35 U.S.C. 154(b) by 0 days.

(21) Appl. No.: 10/823,805

(22) Filed: Apr. 13, 2004

(65) Prior Publication Data

US 2004/0266310 A1 Dec. 30, 2004

(30) Foreign Application Priority Data

Apr. 14, 2003 (JP) ..... 2003-142727

(51) Int. Cl.[7] ..... A63H 33/20; A63H 27/00
(52) U.S. Cl. ..... 446/49; 446/34
(58) Field of Search ..... 446/34, 49, 50, 446/57, 52, 53, 54, 61; 244/142, 147

(56) References Cited

U.S. PATENT DOCUMENTS 704,090 A * 7/1902 Osgood ..... 446/49
1,639,602 A * 8/1927 Gay ..... 446/54
1,777,685 A * 10/1930 Warner ..... 244/142
3,415,010 A * 12/1968 Belz ..... 446/52
3,798,829 A * 3/1974 Worley ..... 446/51
3,996,694 A * 12/1976 Zinser ..... 446/228
4,027,422 A * 6/1977 Schroeder ..... 446/50
4,138,799 A * 2/1979 Cook et al. ..... 446/50
6,422,959 B1 * 7/2002 Hsu ..... 473/588

FOREIGN PATENT DOCUMENTS

JP 354440 12/1945
JP 63-32593 3/1988

* cited by examiner

*Primary Examiner*—Mickey Yu
*Assistant Examiner*—Faye Francis
(74) *Attorney, Agent, or Firm*—Muserlian, Lucas and Mercanti

(57) ABSTRACT

A hand-thrown toy parachute has a canopy. A hollow stick is suspended from the canopy by a plurality of rigging lines substantially at the center of the canopy. A weight is enclosed in the hollow stick to be movable back and forth in the longitudinal direction of the stick under its gravity, and a guide line is connected to the top of the hollow stick at its one end and to the center of the canopy at its the other end.

11 Claims, 9 Drawing Sheets

HAND-THROWN TOY PARACHUTE AND METHOD OF MANUFACTURING THE SAME

BACKGROUND OF THE INVENTION

1. Field of the Invention

This invention relates to a hand-thrown toy parachute which is thrown upward by hand and slowly falls by virtue of the parachute.

2. Description of the Related Art

There has been known a hand-thrown toy parachute comprising a canopy, a weight and a plurality of rigging lines. The toy parachute is intended to be thrown upward by hand with the canopy folded and to fall slowly by virtue of the opened canopy under the gravity of the weight suspended from the canopy with the rigging lines.

However, a hand-thrown toy parachute did not prevail in the past since it could not be thrown satisfactorily high due to air resistance of the folded canopy, and/or that the canopy opened at various timings and often did not open before the toy parachute fell to the ground. Further, in the conventional hand-thrown toy parachute, the rigging lines were apt to get entangled. Further, the conventional hand-thrown toy parachute has drawbacks that the structure is complicated and/or it is hard to handle in safety. In order to overcome such drawbacks in the conventional hand-thrown toy parachute, there has been proposed a toy parachute in which the weight is formed in a box-like body separable into two parts, the folded canopy is placed in the opened weight, and then the weight is temporarily held closed by lines or springs and thrown upward. Further, there have been proposed hand-thrown toy parachutes, for instance, in Japanese Unexamined Utility Model Publication No. 63(1988)-32593 and Japanese Utility Model Publication No. 354440.

However, any one of those proposed hand-thrown toy parachutes cannot satisfactorily overcome the drawbacks described above.

SUMMARY OF THE INVENTION

In view of the foregoing observations and description, the primary object of the present invention is to provide a hand-thrown toy parachute which is easy to play with and can be thrown satisfactorily high.

Another object of the present invention is to provide such a hand-thrown toy parachute in which the canopy is surely opened in the air.

Still another object of the present invention is to provide such a hand-thrown toy parachute which causes no damage to itself nor a human or a material upon inadvertent impact against the human or the material.

Still another object of the present invention is to provide a method of manufacturing such a hand-thrown toy parachute at low cost.

In accordance with a first aspect of the present invention, there is provided a hand-thrown toy parachute comprising a canopy, a hollow stick, a plurality of rigging lines which suspend the hollow stick from the canopy substantially at the center thereof, a weight which is enclosed in the hollow stick to be movable back and forth in the longitudinal direction of the stick under its gravity, and a guide line which is connected to the top of the hollow stick at its one end and to the center of the canopy at its the other end.

In the toy parachute with this arrangement, preparation for throwing the toy parachute can be readily made by folding the canopy around the stick or enveloping the stick in the canopy together with the lines. When the toy parachute in this state is thrown upward underarm holding the ends of the canopy and the stick, the weight automatically moves forward in the stick under the centrifugal force and the toy parachute goes upward pushing the canopy with its center of gravity biased forward.

Further since the length of the stick is added to the length of the arm, moment of throwing is increased and the toy parachute reaches high.

When the toy parachute begins to fall in the air, the weight moves downward in the stick and the center of gravity of the stick is biased downward, whereby the canopy which is higher in air resistance is pulled by the weight-stick assembly and successfully opened. Further, the guide line connected between the top of the stick and the center of the canopy pulls downward the center of the canopy to open the canopy when the guide line is tensed under the gravity of the falling weight-stick assembly.

The canopy may be a known one, and the rigging lines are connected to the outer periphery of the circular or polygonal canopy substantially equally spaced from each other.

The hollow stick is preferably formed in three parts, i.e., a stick nose portion, a hollow cylindrical stick body in which the weight is placed, and a stick grip portion, which are coupled in this order from the side near to the canopy. When the hollow stick is formed in three parts, balancing in weight is facilitated.

The weight is placed in the stick body and is confined in the stick body by stoppers provided on opposite ends of the stick body. The weight may be, for instance, of liquid low in viscosity such as water, fluidized dry sand, or a movable ball or rod of metal, resin or glass.

When the weight is positioned too forward in the stick while the toy parachute is going upward, the toy parachute tends to fall downward with the center of gravity of the toy parachute held forward and without the canopy opened. When the weight is positioned too rearward in the stick while the toy parachute is going upward, the toy parachute cannot reach high. The position of the weight in the stick while the toy parachute is going upward can be controlled by way of the length of the stick nose portion. When the toy parachute begins to fall, the weight larger in mass first falls in the stick. When the distance of movement of the weight in the stick is too long, it requires a long time to open the canopy and the canopy cannot be opened high. The distance of movement of the weight in the stick can be controlled by way of the length of the stick body.

Preferably the stick is formed of light-weight synthetic resin and has a smooth surface small in frictional resistance so that it slides well on the inner surface of the canopy when the canopy opens.

Preferably the length of the stick is such that the lower end portion of the stick is slightly projected beyond the end of the canopy when the canopy is folded with the upper end of the stick in abutment against the center of the canopy.

The stick nose absorbs the impact to protect the toy parachute and the material against which the toy parachute impacts when the toy parachute is inadvertently impacted against the material.

When the rigging lines are connected to the stick at a neck portion below the upper end of the stick, the rigging lines may be small in length. When the rigging lines are small in length, the rigging lines are less apt to be entangled and at the same time, it is easy to envelop the stick in the canopy.

Further, it is preferred that the rigging lines are of a length which is sufficient to permit the canopy to open but does not permit each suspension line to project outside the folded canopy from its end when the rigging lines are forced into the folded canopy.

It is preferred that the hand-thrown toy parachute further comprises a stick bearer which is provided on the under surface of the canopy at the center thereof to bear the top end of the stick to easily release it under the gravity of the stick and the weight and is light in weight.

The stick bearer facilitates positioning of the stick when preparing the toy parachute for throwing. During upward movement of the toy parachute, the stick can be held by the stick bearer and at the same time, the stick can be easily moved away from the canopy as soon as the toy parachute begins to fall. Further, the stick bearer prevents the stick from piercing the canopy.

When the stick bearer is provided, one end of the guide line is connected to the top of the stick and the other end of the guide line is connected to the center of the stick bearer. The length of the guide line is preferably such that the guide line is tensed before the rigging lines are tensed and the center of the canopy is slightly pulled downward to urge the canopy to be opened. When the guide line is first tensed, the canopy can be quickly opened and at the same time, the guide line forms a core line of the canopy, which suppresses the rigging lines from getting entangled. Further, since the guide line pulls downward the center of the canopy, the opening area of the canopy is increased and the floating time of the toy parachute is elongated.

It is preferred that the stick bearer be in the form of a cup open downward which can be loosely engaged with the top end portion of the hollow stick so that the top end portion of the hollow stick can be disengaged from the stick bearer under the gravity of the stick and the weight.

It is preferred that the rigging lines be connected to the stick by way of a harness.

The harness is provided with a plurality of flexible arms and the rigging lines are connected to the respective arms. When the rigging lines are connected to the stick by way of such a harness, connection of the rigging lines to the stick is facilitated and the canopy is quickly positioned in place with respect to the stick when the canopy is opened. Further, the rigging lines are suppressed from getting entangled.

It is preferred that the hand-thrown toy parachute further comprises a head mounted on the upper surface of the canopy opposite to the stick.

The head leads the toy parachute and regulates the flow of air so that the toy parachute reaches higher when the toy parachute is thrown upward. Preferably, the head is formed into a hollow body by light-weighted foamed styrol or synthetic resin. In the case of an inadvertent impact against another material, the head functions as a damper and protects the material and the toy parachute.

It is preferred that the head is mounted on the upper surface of the canopy so that the central axis of the head is slightly inclined with respect to the central axis of the stick at least when the toy parachute is to be thrown up.

In the period just after the toy parachute is thrown where the drag of the toy parachute is strong, the toy parachute goes upward holding its flying posture. However, when the toy parachute reaches high and the drag of the toy parachute is weakened, inclination of the central axis of the head with respect to the central axis of the stick deflects the head from the direction of advance of the toy parachute and a lateral wind pressure acts on the head, whereby the stick falls downward away from the canopy together with the weight in the stick to successfully open the canopy.

The head can be easily mounted on the upper surface of the canopy so that the central axis of the head is slightly inclined with respect to the central axis of the stick at least when the toy parachute is to be thrown up by providing a stick bearer on the under surface of the canopy at the center thereof to bear the top end of the stick to easily release it under the gravity of the stick and the weight, and engaging the top end of the stick with the stick bearer.

It is preferred that at least one of the bottom face of the stick bearer and the top end face of the stick is an inclined surface so that when the top end of the stick is engaged with the stick bearer with the top end face of the stick in surface to surface contact with the bottom face of the stick bearer, the central axis of the head is slightly inclined with respect to the central axis of the stick.

It is preferred that the hand-thrown toy parachute further comprises a wing attached to the outer side surface of the canopy to open toward the center of the canopy when the canopy is folded around the stick.

The wing generates lifting power to open the canopy when the toy parachute is thrown with the center of the canopy positioned at the top.

DESCRIPTION OF THE PREFERRED EMBODIMENTS

Figure 1:
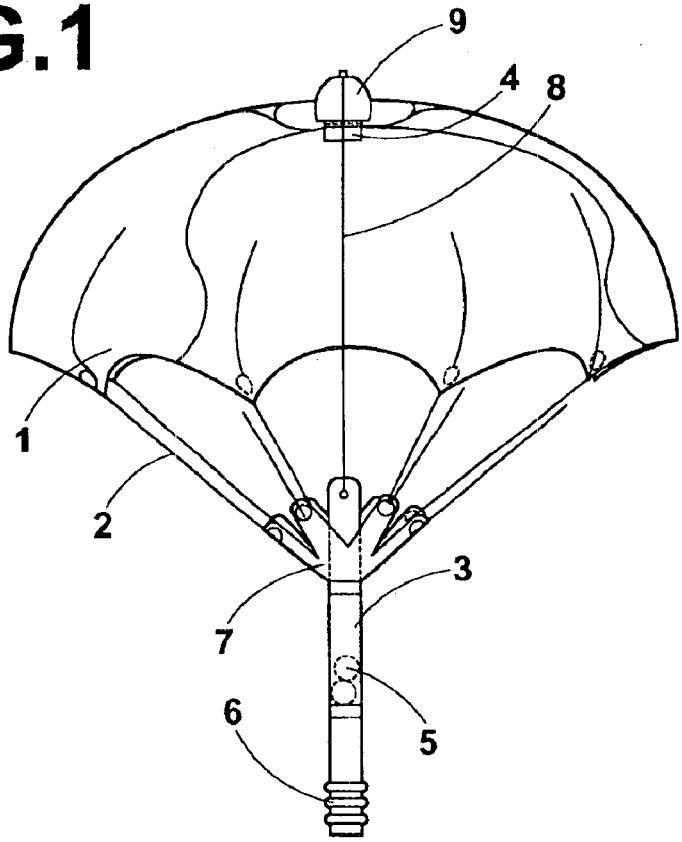
FIG. 1 is a front view showing a toy parachute in accordance with an embodiment of the present invention.

As shown in FIG. 1, a hand-thrown toy parachute of an embodiment of the present invention comprises a canopy 1, a hollow stick 3, a plurality of rigging lines 2 which are connected to the hollow stick 3 by way of a harness 7 to suspend the hollow stick 3 from the canopy 1 substantially at the center thereof, a stick bearer 4 which is provided on the under surface of the canopy 1 at the center thereof, a pair of balls (weight) 5 which are enclosed in the hollow stick 3 to be movable back and forth in the longitudinal direction of the stick 3 under their gravity, a guide line 8 which is connected to the top of the hollow stick 3 at its one end and to the center of the canopy 1 at its the other end and a head 9 mounted on the upper surface of the canopy 1 opposite to the stick bearer 4.

Figure 3:
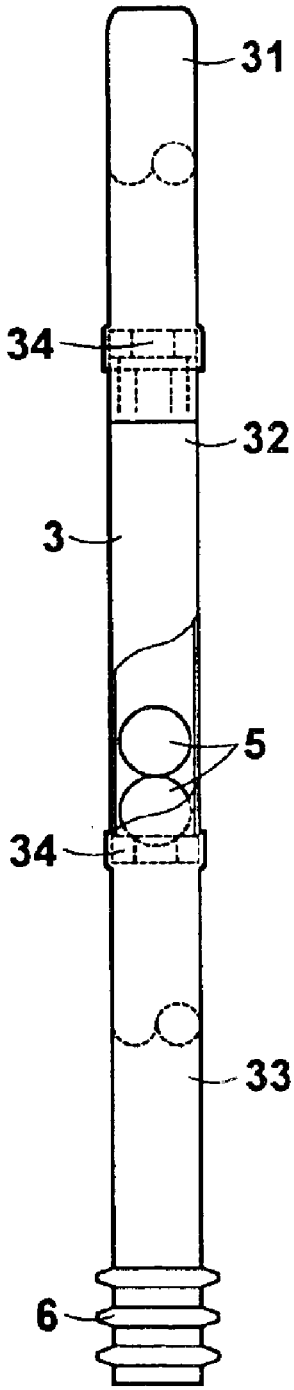
FIG. 3 is a front view showing the stick.

As shown in FIG. 3, the stick 3 comprises a cylindrical stick body 32 between a stick nose portion 31 and a stick grip portion 33, and the pair of balls 5 are placed in the stick body 32 with opposite ends thereof closed by stoppers 34. The grip portion 33 has a grip 6 at its lower end portion.

The stick 3 should be well balanced in weight as a whole.

It is preferred that the rigging lines 2 connecting the canopy 1 and the stick 3 be connected to a neck portion of the stick 3. The neck portion of the stick 3 is a portion of the stick 3 slightly below the top end of the stick 3, and may be for instance, the top end of the stick body 32.

Figure 2A:
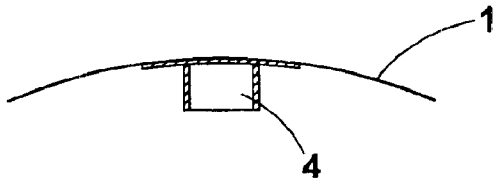
FIG. 2A is a side view showing the stick bearer.
Figure 2B:
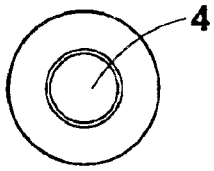
FIG. 2B is a plane view showing the stick bearer.

As shown in FIGS. 2A and 2B, the stick bearer 4 is fixed to the under surface of the canopy 1 at the center thereof and is like a cup open downward. In this embodiment, the stick bearer 4 has a flat bottom surface and the top end of the stick 3 is flat and accordingly the central axis of the head 9 fixed to the canopy 1 on the upper side opposite to the stick bearer 4 is substantially aligned with the central axis of the stick 3 when the stick 3 is engaged with the stick bearer 4 with the top face of the stick 3 in face to face contact with the bottom surface of the stick bearer 4.

Figure 4:
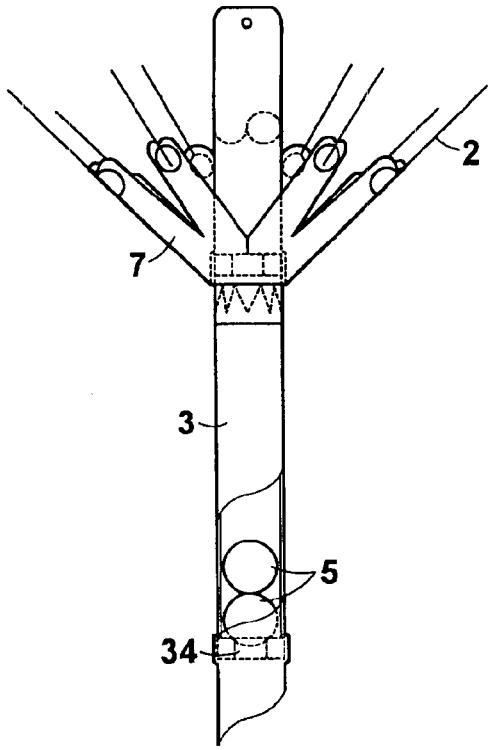
FIG. 4 is a front view showing the harness.
Figure 5:
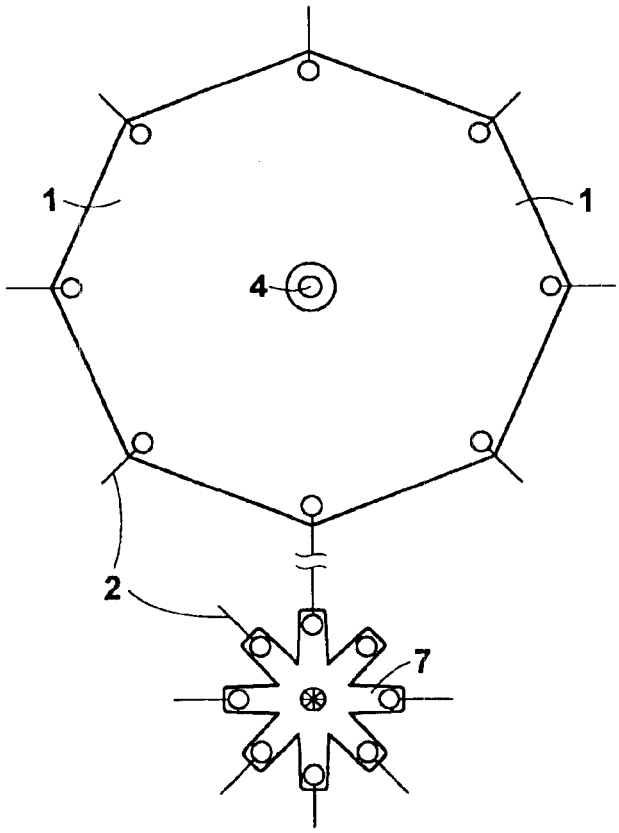
FIG. 5 is a plan view showing the canopy and the harness.

As shown in FIGS. 4 and 5, the harness 7 is formed of light and flexible film and has a plurality of radial arms. One of the rigging lines 2 is connected to each arm of the harness 7.

Figure 8:
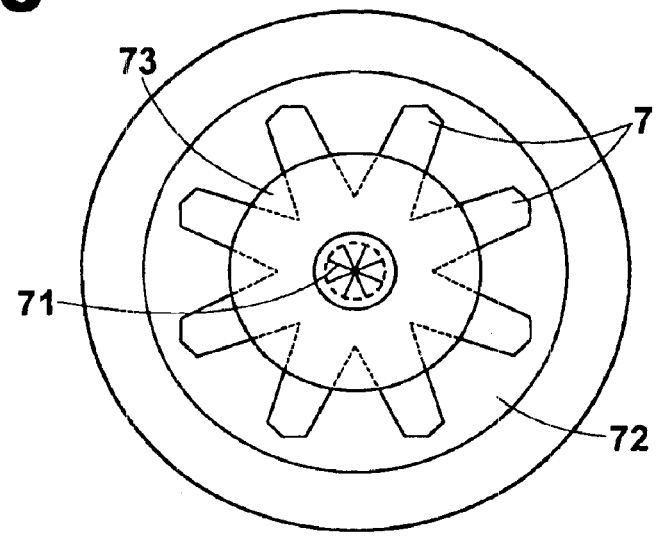
FIG. 8 is a plan view of the harness mounting jig.

As shown in FIG. 8, nicks 71 are cut in the harness 7 to extend from the center of the harness 7 to positions according to the outer diameter of the stick 3 and the stick 3 is inserted into the hole formed at the center of the harness 7 by the nicks 71.

The length of the guide line 8 is such that the guide line 8 is tensed before the rigging lines 2 are tensed when the stick 3 falls with its grip portion 33 directed downward and the center of the canopy 1 is slightly pulled downward to urge the canopy 1 to be opened.

Figure 6:
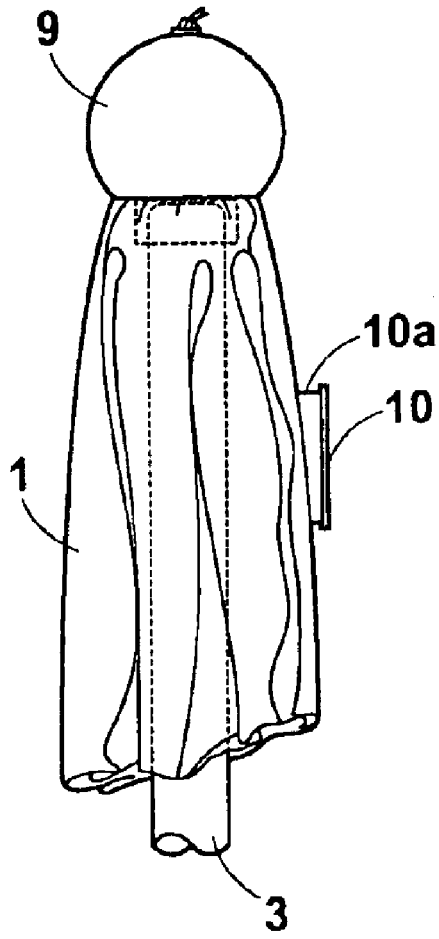
FIG. 6 is a front view showing a modification of the toy parachute in accordance with the embodiment of the present invention in a state where the toy parachute is ready to be thrown.
Figure 14A:
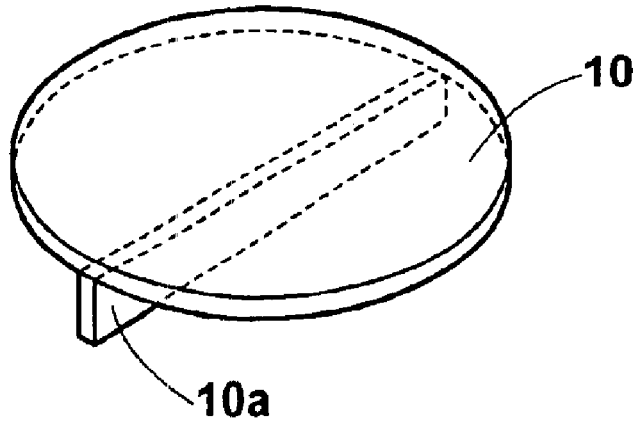
FIG. 14A is a perspective view of the wing employed in the embodiment of the present invention shown in FIG. 6.
Figure 14B:
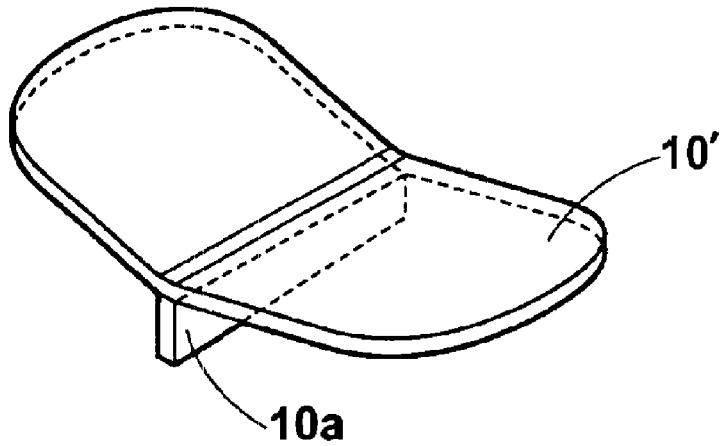
FIG. 14B is a perspective view of another example of the wing.

A wing 10 may be attached to the outer side surface of the canopy 1 as shown in FIG. 6. As shown in FIG. 6, the wing 10 is attached to the outer surface of the canopy 1 by way of a spacer 10*a* to open toward the head 9 when the canopy 1 is folded around the stick 3. FIG. 14A shows a perspective view of the wing 10. Another example of the wing 10' is shown in FIG. 14B, wherein the opposite wing portions are slightly bent up to enhance the lifting force. With this arrangement, lifting power which urges the canopy 1 to be opened acts on the wing 10 when the toy parachute flies with the head 9 positioned at the top and opens the canopy 1. A plurality of wings 10 maybe provided to surround the canopy 1 when the canopy 1 is folded around the stick 3.

A method of manufacturing the stick body 32 will be described with reference to FIGS. 7A to 7C, hereinbelow.

Figure 7A:
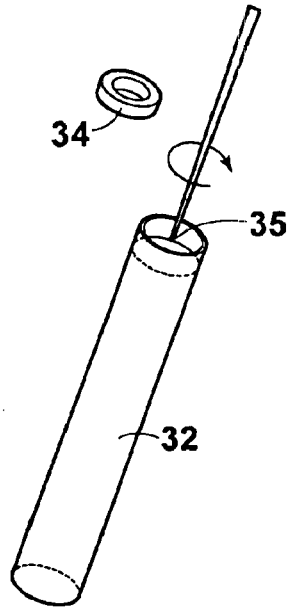
FIGS. 7A to 7C are views for illustrating manufacture of the stick body.
Figure 7B:
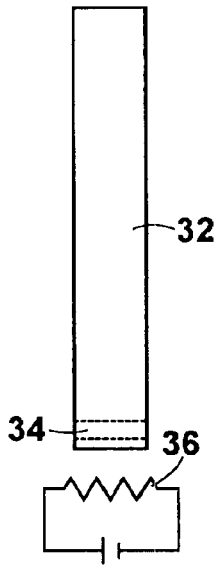
Figure 7C:
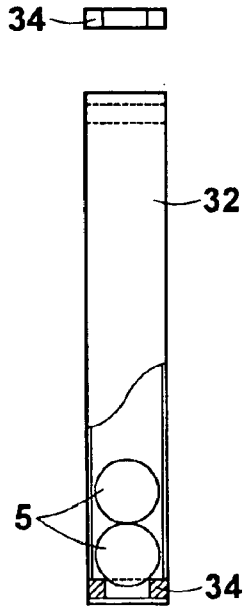

First as shown in FIG. 7A, the inner surface of the stick body 32 is coated with adhesive 35 at one end portion thereof and a stopper 34 is fixed to the inner surface of the stick body 32 at one end thereof by the adhesive 35. Then the stick body 32 is inverted and the adhesive 35 is dried with a heater 36 as shown in FIG. 7B. Thereafter, a pair of balls 5 are placed in the stick body 32 and another stopper 34 is fixed to the inner surface of the stick body 32 at the other end thereof in a similar manner as shown in FIG. 7C. Otherwise, the stoppers 34 may be formed to close the opposite ends of the stick body 32 by heat-forming.

Then the upper end of the stick nose portion 31 is rounded and the lower end portion of the same is expanded while a grip 6 is formed on the lower end portion of the stick grip portion 33 and the upper end portion of the same is expanded. The opposite end portions of the stick body 32 are respectively force-fitted in the lower end portion of the stick nose portion 31 and the upper end portion of the stick grip portion 33.

Figure 9:
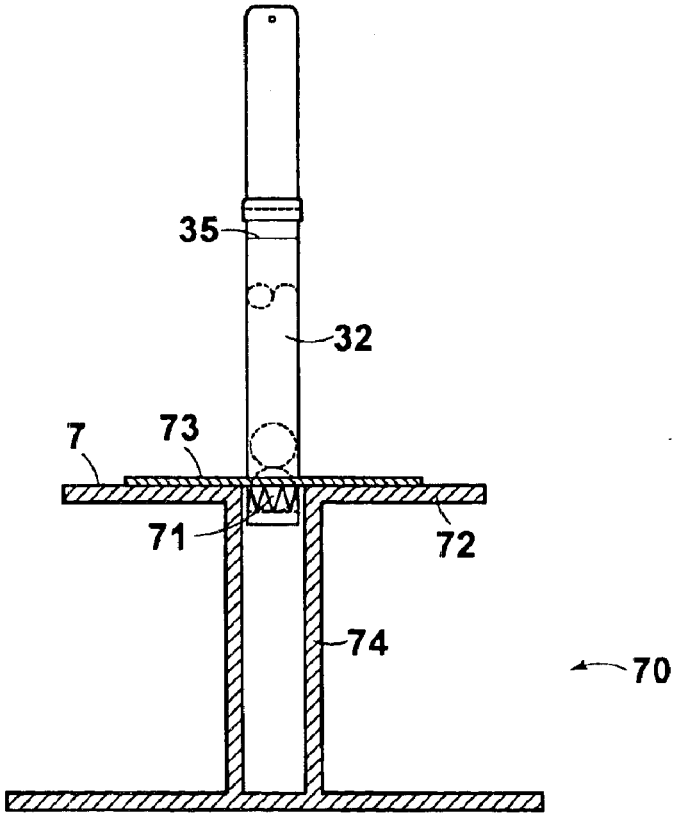
FIG. 9 is a front view of the harness mounting jig.

A method of mounting the harness 7 on the stick 3 will be described with reference to FIGS. 8 and 9, hereinbelow.

In this particular embodiment, a harness mounting jig 70 is employed. The harness mounting jig 70 comprises a harness mounting table 72 having a circular and horizontal upper surface on which the harness 7 is spread and a tubular portion 74 which vertically extends downward from the center of the harness mounting table 72 as shown in FIGS. 8 and 9. The stick body 32 is inserted into the tubular portion 74 of the harness mounting jig 70.

The length of tubular portion 74 is such that when the stick body 32 is fully inserted into the tubular portion 74, the portion of the stick body 32 around which the adhesive 35 is coated is positioned below the surface of the harness mounting table 72 by several millimeters.

The harness 7 is spread over the surface of the harness mounting table 72 with the center of the nicked portion aligned with the center of the tubular portion 74 and then a retainer plate 73 having a central opening is pressed against the surface of the harness mounting table 72 with its central opening aligned with the tubular portion 74 to hold the harness 7 therebetween. Adhesive 35 is coated around an upper portion of the stick body 32 having a stick nose 31 connected thereto. The stick body 32 having the stick nose 31 connected thereto and coated with the adhesive 35 is inserted into the tubular portion 74 from the lower end thereof. As the stick body 32 is inserted home into the tubular portion 74, the portion of the stick body 32 coated with the adhesive 35 comes to contact with the triangular portions of the harness 7 defined by the nicks 71 and the triangular portions are bonded to the outer surface of the stick body 32, whereby the harness 7 is bonded to the stick 3.

Figure 10:
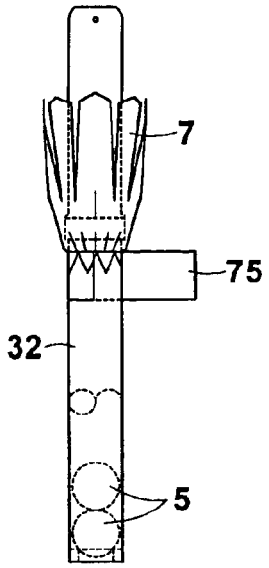
FIG. 10 is a front view for illustrating the reinforcing adhesive tape.

After the retainer plate 73 is removed and the stick body 32 is drawn out from the tubular portion 74, a reinforcing adhesive tape 75 is wound around the triangular portions of the harness 7 bonded to the stick 3 as shown in FIG. 10.

In this particular embodiment, the rigging lines 2 are connected to the canopy 1 and the harness 7 in the following manner.

Figure 11:
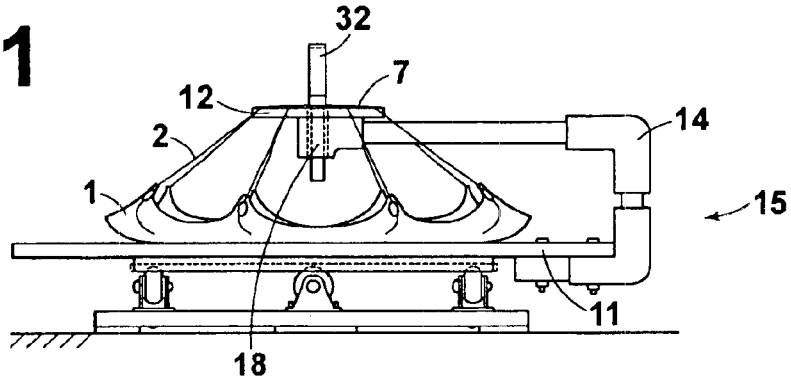
FIG. 11 is a front view of the stringing jig.
Figure 12:
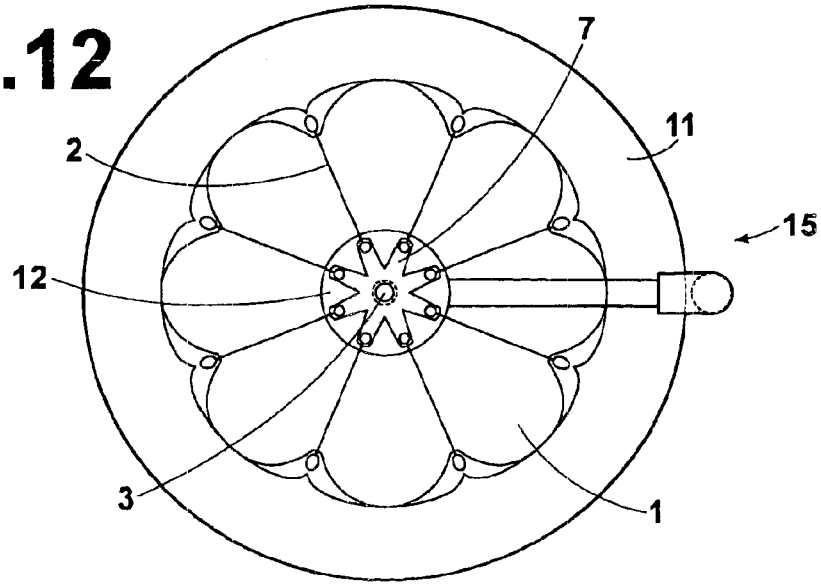
FIG. 12 is a plan view of the stringing jig.

A stringing jig 15 is employed. As shown in FIGS. 11 and 12, the stringing jig 15 comprises a canopy stringing table 11 for connecting one ends of the rigging lines 2 to the canopy 1 and a harness stringing table 12 for connecting the other ends of the rigging lines 2 to the harness 7.

The canopy stringing table 11 is rotatable and is sized so that the spread canopy 1 does not project from the edge thereof. The harness stringing table 12 is smaller than the canopy stringing table 11 and is supported in a cantilever fashion by a support member 14 fixed to the lower side of the canopy stringing table 11 above the canopy stringing table 11 with its axis aligned with the axis of the canopy stringing table 11. Further a stick holding tube 13 is provided on the harness stringing table 12 at the center thereof.

The canopy 1 is spread and placed on the canopy stringing table 11. Then one ends of the rigging lines 2 which have been cut in the same lengths are bonded to the canopy 1 by adhesive in sequence and then each of the junctions is reinforced by a small fraction of single-sided adhesive tape bonded to the canopy 1 from above the line 2 while the canopy stringing table 11 is intermittently rotated.

The stick body 32 provided with the nose portion 31 and the harness 7 is inserted into the stick holding tube 13 from the nose portion 31 so that the arms of the harness 7 are radially projected from the fixed stick body 32.

In this state, the other ends of the rigging lines 2 the one ends of which have been connected to the canopy 1 are connected to the respective arms.

Then thus strung toy parachute is removed from the stringing jig 15.

Figure 13:
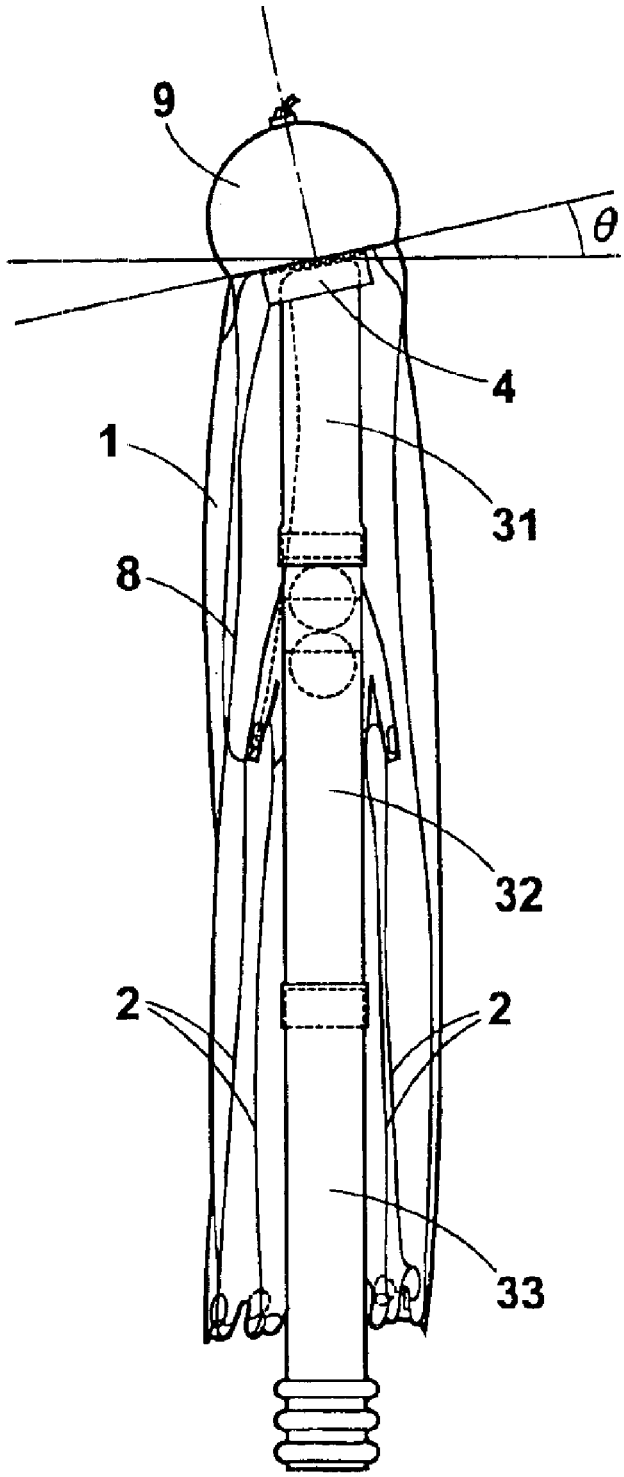
FIG. 13 is a front view of the toy parachute in accordance with another embodiment of the present invention in a state where the toy parachute is ready to be thrown.

FIG. 13 is a front view of the toy parachute in accordance with another embodiment of the present invention in a state where the toy parachute is ready to be thrown.

The toy parachute of this embodiment has a stick 3 in the form of a cylindrical body whose top end is obliquely cut at an angle of □. In this embodiment, the central axis of the head 9 fixed to the canopy 1 on the upper side opposite to the stick bearer 4 is inclined to the central axis of the stick 3 when the stick 3 is engaged with the stick bearer 4 with the top face of the stick 3 in face to face contact with the bottom surface of the stick bearer 4.

When the toy parachute is thrown up in this state, the toy parachute goes upward holding its flying posture in the period just after the toy parachute is thrown where the drag of the toy parachute is strong. However, when the toy parachute reaches high and the drag of the toy parachute is weakened, inclination of the central axis of the head 9 with respect to the central axis of the stick 3 deflects the head 9 from the direction of advance of the toy parachute and a lateral wind pressure acts on the head 9, whereby the stick 3 is disengaged from the stick bearer 4 and falls downward away from the canopy 1 together with the weight 5 in the stick 3 to successfully open the canopy 1.

This inventor performed tests on successive two days. On the first day, there was no wind and on the second day, there were south winds at 4 m. In the tests, the stick 3 had a stick nose portion whose length was 50 mm and whose top end was obliquely cut. Each day, the toy parachute was thrown ten times. On the first day, the canopy was opened seven times and on the second day, the canopy was opened nine times. On the first day, the toy parachute reached a height of 7.8 m and the canopy was opened at a height of 5.2 m on average and on the second day, the toy parachute reached a height of 7.8 m and the canopy was opened at a height of 5.8 m on average, which were acceptable.

What is claimed is:

1. A hand-thrown toy parachute comprising a canopy, a hollow stick, a plurality of rigging lines which suspend the hollow stick from the canopy substantially at the center thereof, a weight which is enclosed in the hollow stick to be movable back and forth in the longitudinal direction of the stick under gravity, and a guide line which is connected to the top of the hollow stick at one end of the guideline and to the center of the canopy at other end often.

2. A hand-thrown toy parachute as defined in claim 1 further comprising a stick bearer which is provided on the under surface of the canopy at the center thereof to bear the top end of the stick to easily release the same under the gravity of the stick and the weight.

3. A hand-thrown toy parachute as defined in claim 2 in which the stick bearer is in the form of a cup open downward and can be loosely engaged with the top end portion of the hollow stick so that the top end portion of the hollow stick can be disengaged from the stick bearer under the gravity of the stick and the weight.

4. A hand-thrown toy parachute as defined in claim 1 in which the rigging lines are connected to the stick by way of a harness.

5. A hand-thrown toy parachute as defined in claim 1 further comprising a head mounted on the upper surface of the canopy opposite to the stick.

6. A hand-thrown toy parachute as defined in claim 2 further comprising a head mounted on the upper surface of the canopy opposite to the stick bearer.

7. A hand-thrown toy parachute as defined in claim 6 in which at least one of the bottom face of the stick bearer and the top end face of the stick is an inclined surface so that when the top end of the stick is engaged with the stick bearer with the top end face of the stick in surface to surface contact with the bottom face of the stick bearer, the central axis of the head is inclined with respect to the axis of the stick.

8. A hand-thrown toy parachute as defined in claim 1 further comprising a wing attached to the outer side surface of the canopy to open toward the center of the canopy when the canopy is folded around the stick.

9. A method of manufacturing a hand-thrown toy parachute comprising a canopy, a hollow stick, a plurality of rigging lines which suspend the hollow stick from the canopy substantially at the center thereof, a weight which is enclosed in the hollow stick to be movable back and forth in the longitudinal direction of the stick under gravity, and a guide line which is connected to the top of the hollow stick at one end of the guideline and to the center of the canopy at the other end of the guideline, the method comprising the steps of forming the stick in a stick nose portion, a cylindrical stick body, and a stick grip portion by a tube of light-weight resin, placing the weight in the stick body to be movable back and forth in the longitudinal direction of the stick body under gravity, and sealing the opposite ends of the stick body by heat forming a stopper on opposite ends thereof, rounding the upper end of the stick nose portion and expanding the lower end portion of the same, forming a grip on the lower end portion of the stick grip portion and expanding the upper end portion of the same, force-fitting one end portion of the stick body in the expanded lower end portion of the stick nose portion, force-fitting the other end portion of the stick body in the expanded upper end portion of the stick grip portion, and smoothing the junctions between the stick nose portion and the stick body and between the stick grip portion and the stick body, thereby forming the stick which is suitably balanced in weight.

10. A method as defined in claim 9 further comprising the steps of coating an upper peripheral surface of the stick body with adhesive, preparing a harness which is formed of light and flexible film and has a plurality of radial arms and in which nicks are cut to extend from the center of the harness, preparing a harness mounting jig comprising a harness mounting table having a circular and horizontal upper surface and a tubular portion which vertically extends downward from the center of the harness mounting table, spreading the harness over the harness mounting table of the harness mounting jig with the center of the nicked portion of the harness aligned with the center of the tubular portion of the harness mounting jig, pressing a retainer plate having a central opening against the surface of the harness mounting table with its central opening aligned with the tubular portion to hold the harness therebetween, and inserting the stick into the tubular portion of the harness mounting jig so that triangular portion of the harness defined by the nicks are bonded to the outer peripheral surface of the stick by the adhesive.

11. A method as defined in claim 9 further comprising the steps of preparing a stringing jig comprising a canopy stringing table for connecting one ends of the rigging lines to the canopy, a harness stringing table for connecting the other ends of the rigging lines to the harness and a stick holding tube provided on the harness stringing table at the center thereof, the canopy stringing table being rotatable and the harness stringing table being supported above the canopy stringing table with its axis aligned with the axis of the canopy stringing table, spreading and placing the canopy on the canopy stringing table and bonding one ends of the rigging lines which have been cut in the same lengths to the canopy by adhesive in sequence, while intermittently rotating the canopy stringing table, inserting the stick body provided with the nose portion and the harness into the stick holding tube from the nose portion so that the arms of the harness are radially projected from the fixed stick body, and connecting the other ends of the rigging lines the one ends of which have been connected to the canopy to the respective arms of the harness.

* * * * *